US006971950B2

(12) United States Patent
Dudovicz

(10) Patent No.: US 6,971,950 B2
(45) Date of Patent: Dec. 6, 2005

(54) POLISHING SILICON WAFERS

(75) Inventor: Walter Dudovicz, Salem, NH (US)

(73) Assignee: Praxair Technology, Inc., Danbury, CT (US)

( * ) Notice: Subject to any disclaimer, the term of this patent is extended or adjusted under 35 U.S.C. 154(b) by 99 days.

(21) Appl. No.: 10/689,678

(22) Filed: Oct. 22, 2003

(65) Prior Publication Data

US 2004/0087262 A1 May 6, 2004

Related U.S. Application Data

(63) Continuation of application No. 08/941,386, filed on Sep. 30, 1997, now Pat. No. 6,736,714, which is a continuation-in-part of application No. 08/903,004, filed on Jul. 30, 1997, now abandoned.

(51) Int. Cl.[7] ..... B24B 21/04
(52) U.S. Cl. ..... 451/307; 451/533; 451/536
(58) Field of Search ..... 451/535, 388, 451/41, 527, 307, 296, 526, 531, 533, 536, 451/532; 51/530, 537, 299, 298; 428/222; 474/263; 442/238

(56) References Cited

U.S. PATENT DOCUMENTS

| | | | | |
|---|---|---|---|---|
| 27,817 A | | 4/1860 | Mayall | |
| 81,986 A | | 9/1868 | Crane | |
| 4,109,543 A | | 8/1978 | Foti | |
| 4,282,011 A | | 8/1981 | Terpay | |
| 4,396,657 A | * | 8/1983 | Ibrahim | 428/36.3 |
| 4,437,269 A | | 3/1984 | Shaw | |
| 4,478,610 A | * | 10/1984 | Parekh et al. | 51/298 |
| 4,520,059 A | | 5/1985 | Worrall et al. | |
| 4,576,612 A | | 3/1986 | Shukla et al. | |
| 4,649,074 A | | 3/1987 | Borel | |
| 4,728,552 A | | 3/1988 | Jensen, Jr. | |
| 4,753,838 A | * | 6/1988 | Kimura et al. | 428/91 |
| 4,796,749 A | | 1/1989 | Lefferts | |
| 4,927,432 A | | 5/1990 | Budinger et al. | |
| 4,954,141 A | | 9/1990 | Takiyama et al. | |
| 4,962,562 A | | 10/1990 | Englund et al. | |
| 5,020,283 A | | 6/1991 | Tuttle | |
| 5,164,241 A | | 11/1992 | De La Porte et al. | |
| 5,177,908 A | | 1/1993 | Tuttle | |
| 5,197,999 A | * | 3/1993 | Thomas | 51/298 |
| 5,212,910 A | * | 5/1993 | Breivogel et al. | 451/530 |
| 5,234,867 A | | 8/1993 | Schultz et al. | |
| 5,257,478 A | | 11/1993 | Hyde et al. | |
| 5,287,663 A | | 2/1994 | Pierce et al. | |

(Continued)

FOREIGN PATENT DOCUMENTS

EP 696495 10/1999

(Continued)

OTHER PUBLICATIONS

Fynn et al., "The Cutting and Polishing of Electro-optic Materials" (John Wiley and Sons, 1979) pp 82-83.

*Primary Examiner*—George Nguyen
(74) *Attorney, Agent, or Firm*—Iurie A. Schwartz

(57) ABSTRACT

An endless belt for a belt type polishing machine comprises a support fabric and a polymer layer of relatively low hardness. The polymer layer is formed with drainage grooves. The support fabric may comprise a non woven or woven material, or a membrane with oriented reinforcing yarns. A further version comprises a spiral-link fabric supporting a woven or non woven layer carrying the polymer layer. The polymer layer may be a double layer, the upper of which is either harder or softer than the lower layer.

17 Claims, 2 Drawing Sheets

U.S. PATENT DOCUMENTS

| | | | | |
|---|---|---|---|---|
| 5,329,734 | A | 7/1994 | Yu | |
| 5,454,750 | A | 10/1995 | Cosmano et al. | |
| 5,482,756 | A | 1/1996 | Berger et al. | |
| 5,487,697 | A | 1/1996 | Jensen | |
| 5,489,233 | A | 2/1996 | Cook et al. | |
| 5,514,456 | A | 5/1996 | Lefferts | |
| 5,534,106 | A | 7/1996 | Cote et al. | |
| 5,558,568 | A | 9/1996 | Talieh et al. | |
| 5,573,619 | A | 11/1996 | Benedict et al. | |
| 5,573,844 | A | 11/1996 | Donovan et al. | |
| 5,575,707 | A | 11/1996 | Talieh et al. | |
| 5,578,362 | A | 11/1996 | Reinhardt et al. | |
| 5,605,760 | A | 2/1997 | Roberts | |
| 5,692,947 | A | 12/1997 | Talieh et al. | |
| 5,735,731 | A | 4/1998 | Lee | |
| 5,924,917 | A * | 7/1999 | Benedict et al. | 451/526 |
| 6,328,642 | B1 | 12/2001 | Pant et al. | |
| 6,406,576 | B1 * | 6/2002 | Benedict et al. | 156/137 |
| 6,406,577 | B1 * | 6/2002 | Benedict et al. | 156/137 |
| 6,736,714 | B2 * | 5/2004 | Dudovicz | 451/536 |

FOREIGN PATENT DOCUMENTS

| | | |
|---|---|---|
| JP | 63267155 | 11/1988 |
| WO | 9616436 | 5/1996 |
| WO | 9835785 | 8/1998 |
| WO | 9835786 | 8/1998 |
| WO | 9836442 | 8/1998 |

* cited by examiner

POLISHING SILICON WAFERS

This is a Division of prior U.S. application(s) Ser. No. 08/941,386, filing date Sep. 30, 1997 now U.S. Pat. No. 6,736,714 and which in turn is a Continuation-in-Part of application Ser. No. 08/903,004, filing date Jul. 30, 1997 now abandoned.

This invention relates to apparatus for polishing silicon wafers.

BACKGROUND OF THE INVENTION

Silicon wafers are produced as precursors from which micro-electronic semiconductor components are produced. The wafers are grown for example by deposition of silicon onto a substrate, to produce discs typically 20 cm in diameter, which are split by cleavage parallel to their major surfaces (analogous to the cleavage of slate) to produce two thinner wafers. The resulting wafers require to be polished to give totally flat and planar surfaces for deposition of electronic components onto the surface by standard lithographic and etching techniques to form integrated chip semiconductor devices. Typically a 20 cm diameter wafer will produce forty micro processor chips.

The designed size of such integrated chips is steadily decreasing and the number of layers applied, e.g. by lithography onto the silicon surface is rising, to produce ever smaller and increasingly complex micro-circuits. Present semiconductors typically incorporate 3 or 4 metal layers, whilst it is expected that future designs will contain 5 or more layers. This increase in the number of layers applied is leading to ever more stringent requirements on the smoothness and planarity of the silicon wafers, since pits or scratches may produce voids which cannot be bridged by deposited material, as the widths and thicknesses of deposited layers are decreased, leading to unplanned resistances where a conductor is narrowed, or capacitances/non-conductive gaps, where breaks occur in deposited conductor layers, which interfere with or compromise the planned operation of the circuit.

The standard wafer polishing technique in use at present is to remove a wafer from a stack, or cassette of e.g. 10 wafers, by means of a robot arm, and manoeuvre the disc into position ver a rotating disc. The disc is usually coated with polyurethane, and the wafer is held in place by an overhead platen whilst being polished by the rotating disc. This is an adaptation of optical polishing technology used for polishing lenses, mirrors and other optical components. Once polishing is completed, the robot arm removes the wafer and transfers it to another work station for eventual lithographic deposition steps.

A significantly different approach is so-called Linear Planarisation Technology, developed by OnTrak, wherein an endless travelling belt is used to polish the wafer, in place of the rotating disc form of polishing tool. The belt used in this method is described in EP-A-0696495 and comprises an endless belt of sheet steel, having a polyurethane coating of low Shore A hardness. A major problem with these belts is the poor adhesion of polyurethane to steel. An adhesive or coupling agent is required for bonding between the steel and polyurethane to take place but in spite of the use of such an agent bond strength is insufficient to withstand the harsh conditions under which the belt operates—particularly the frictional forces occurring between the belt and wafer in the zone of contact. The tendency is for the polyurethane to wear out or to flake off within two days or so, and to repair this an area around the damaged coating has to be removed for fresh polyurethane to be added as a patch. This leaves seams or joints between the original coating and the patches which must be removed by complicated and expensive high-precision machinery and processes so as to ensure that a flat planar belt surface is maintained.

OBJECTS OF THE INVENTION

An object of the invention is to provide a belt-type apparatus for polishing silicon wafers wherein the problems arising from the use of a sheet metal belt, having a poorly bonded coating, are at least substantially overcome.

SUMMARY OF THE INVENTION

This invention provides for use in polishing silicon wafers, an endless belt to act as a polishing tool, characterised in that the belt comprises a woven or non-woven fabric coated with a suitable polymer.

The polymer is preferably polyurethane, preferably with a low Shore D hardness, e.g. from 65–75.

Alternatively the polymer may be any thermoset or thermoplastic polymer having a reasonably high abrasion resistance, such as polyamides, silicones, fluoropolymers, epoxy resins and thermoplastic polyurethanes.

The coating may comprise two or more layers of different hardnesses. The coating may comprise at least one layer of partially fused polymeric particles, or two or more thermoplastic polymers of different melting points.

The upper layer may be the harder layer.

On the other hand the intermediate layer may be the harder layer, and the upper layer may comprise a foamed plastic, or be formed of or incorporate thermally expandable expanded polystyrene beads which form pores in the plastics layer. Hollow microbeads of plastics, glass or soluble material may be incorporated in the upper layer.

Abrasive particles or fibres may be added to the upper layer, which may constitute a transparent coating, or be micro textured with micro-scaled grooves or surface roughness.

The fabric may be a substrate which is wove in endless form embodying yarns of high tensile strength and relatively low elongation.

A fabric woven in endless form lacks the weak spots of a seam or splice, which is a great advantage as these belts operate under extremely high tension to prevent the formation of ripples or wrinkles.

The belt thickness is typically 01.–0.2 inches, whilst the coating thickness is in the range 0.05–0.09 inches.

Examples of suitable yarns are meta- or para-aramids such as KEVLAR, NOMEX or TWARON; PBO or its derivatives; polyetherimide; polyimide; polyetherketone; PEEK; gel-spun UHMW polyethylene (such as DYNEEMA or SPECTRA); or polybenzimidazole; or other yarns commonly used in high-performance fabrics such as those for making aerospace parts. Mixtures or blends of any two or more yarns may be used, as may glass fibres (preferably sized), carbon or ceramic yarns including basalt or other rock fibres, or mixtures of such mineral fibres with synthetic polymer yarns. Any of the above yarns may be blended with organic yarns such as cotton. The belts according to the invention woven from these yarns are strong in the machine direction and sufficiently rigid in the cross machine direction.

Most preferred are aramid yarns due to their low weight and high strength.

A non woven fabric substrate may be provided in place of a woven substrate and be formed from any one, or a blend or mixture of any of the above mentioned yarns or fibres. More than one nonwoven substrate may be provided, preferably two, and they may be vertically aligned or offset relative to one another.

A belt substrate may comprise a non woven fabric with additional spaced apart linear yarns extending substantially in a common direction, and a polymeric matrix material interconnecting and at least partially encapsulating each of the yarns. The linear yarns preferably are oriented in the running direction of the belt, but may also or instead be oriented in the cross-machine direction, i.e. transversely of the belt e.g. as described in GB-A-2202873. Extra reinforcing yarns extending substantially in the machine direction may also be provided.

The belt substrate preferably has a relatively high open area due to the increase in delamination resistance, particularly if the substrate is fully impregnated with polymer. For this, a spiral link belt of the kind disclosed in GB-A-2051154, comprising an array of eg. cross-machine direction hinge wires, connected by interdigitating flattened helical coils is particularly preferred, as one large open area woven fabrics. This substrate may support a woven or non-woven fabric which is coated or partially or fully impregnated with the suitable polymer.

The surface of the belt may be formed with grooves extending in the running direction of the belt to remove wet slurry generated during the polishing process. This slurry can be removed from the belt grooves using one or more high pressure water jets, rotating fine brushes or hard non-metallic (e.g. ceramic) stylii.

DESCRIPTION OF EXEMPLIFIED EMBODIMENTS

Figure 1:
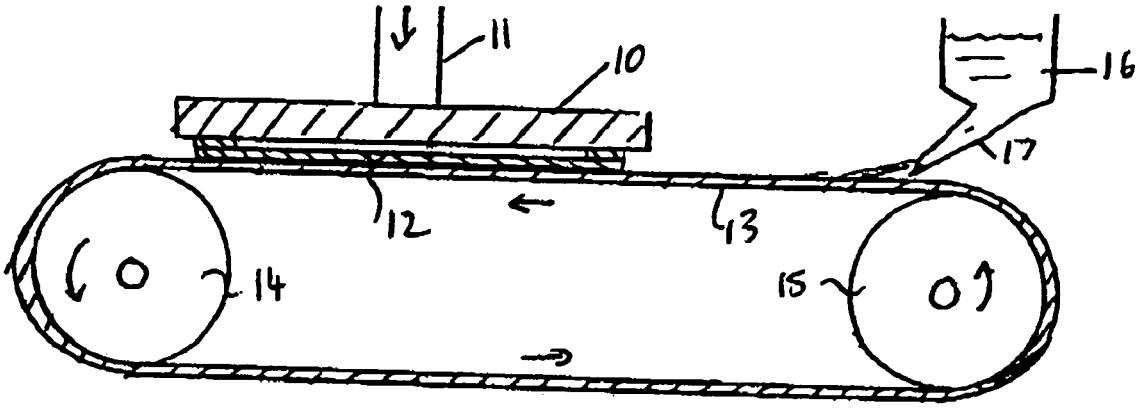
FIG. 1 is a diagram of a continuous belt-type apparatus for polishing silicon wafers, of the kind incorporating a belt in accordance with the invention.

FIG. 1 is a diagrammatic view of a continuous belt machine for polishing and planarising silicon wafers. A platen 10 operable by a hydraulic or pneumatic ram 11, holds a silicon wafer 12 flat on the surface of a continuous belt 13, after the wafer 12 has been put in place by a remotely controlled or autonomous handling system such as a robotic arm (not shown). Belt 13 is passed around end rollers 14, 15 and is driven in the sense indicated by the arrows on the drawing. A polishing slurry, containing very fine grade abrasive is fed onto the upper surface of the belt from a reservoir 16, through a feeder 17. An example of a suitable polishing slurry is disclosed in WO 96/16436 by Advanced Micro Devices, Inc. The feeder 17 may be associated with means known in the prior art for achieving the desired distribution of the slurry on the belt, prior to encountering the wafer 12 which is to be polished by the chemical-mechanical polishing process.

Polishing is achieved by the motion of the belt 13 in contact with the surface of the wafer 12 which is to be polished, in forced contact under pressure with the wafer surface, from the platen 10 and ram 11.

In accordance with the invention the belt 13 is made from a substrate at least coated with a suitable polymeric material and some possible structures are illustrated in the following figures by way of example.

Figure 2:
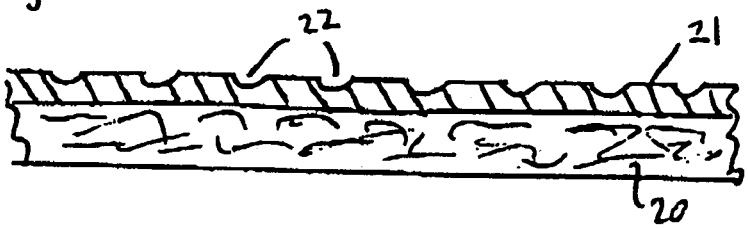
FIG. 2 is a fragmentary enlarged diagrammatic cross-section taken across the machine direction of one embodiment of polishing belt of the invention.

In FIG. 2 is a non-woven fibrous batt 20, preferably impregnated and reinforced with a suitable resin, is coated on its upper surface, for contacting wafers to be polished, with a layer 21 of polyurethane having a low Shore-A hardness. The upper surface is formed with a multitude of parallel machine-direction grooves 22 for drainage of the used slurry (comprising abrasive particles, liquid medium and particles of silicon removed from the wafer) from the polishing site.

Figure 3:
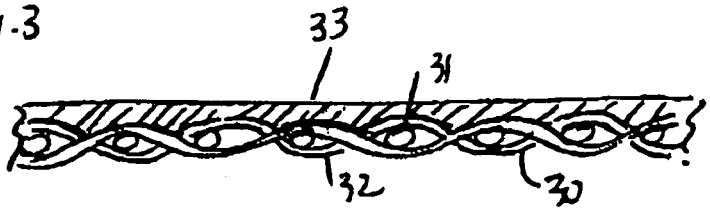
FIG. 3 is a view similar to FIG. 2 of another embodiment of the belt of the invention.

In FIG. 3 a woven substrate 30 is shown, comprising machine direction yarns 31, with cross-machine direction yarns 32 interwoven through them. The simplest possible weave pattern is shown, but of course more complex weave patterns, including multi-tier MD yarns 31 may be used, to obtain a bulkier woven substrate. Multiple layers of woven substrate 30 may be overlaid and impregnated with a binder or resin if desired. The yarns 32 may run in the cross-machine direction with the interwoven yarns 31 extending in the machine direction. The substrate 30 is coated on its upper polishing surface with a layer 33 of polyurethane having a low Shore-A-hardness. This preferably strikes into the woven substrate, and may impregnate the substrate completely.

Figure 4:
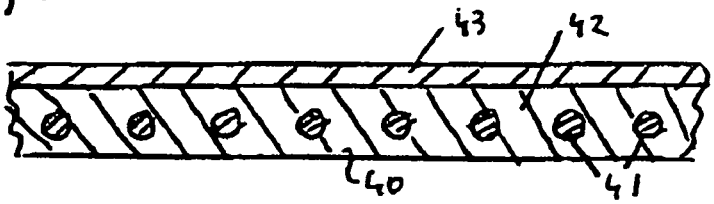
FIG. 4 is a view similar to FIGS. 2 and 3 of yet another embodiment of the belt according to the invention.

In FIG. 4 a non woven substrate 40 comprises an array of yarns 41, extending eg in the machine direction, encapsulated in a polymeric material matrix 42. A coating 43 of a polyurethane having a low-Shore A hardness is provided on the polishing surface of the substrate 40. The substrate may be of the kind described in GB-A-2202873 and may include vertical passages through the substrate as disclosed in that specification.

Figure 5:
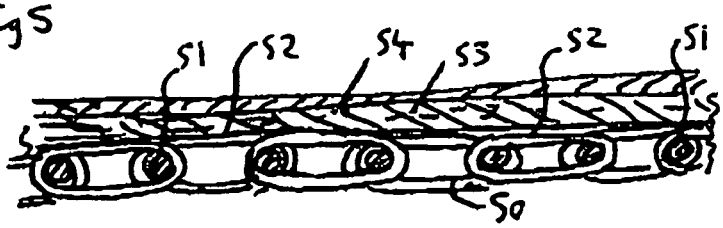
FIG. 5 is a similar view f a fourth embodiment of the belt according to the invention.

In FIG. 5 a substrate 50 is provided which comprises a link belt f the kind disclosed in GB-A-2051154. This has an array of cross-machine direction hinge-wires 51, each pair of which are connected by respective flattened helical coils 52, which each interdigitate with the adjacent coils about the respective hinge wires. Substrate 50 is covered with a fibrous layer, such as a non woven plastics impregnated and reinforced batt 53, which is in turn coated with a layer 54 of a low Shore-A hardness polyurethane.

The hinge wires 51 and helical coils 52 may be of a suitable polyamide material or less preferably of metal wire.

Figure 6:
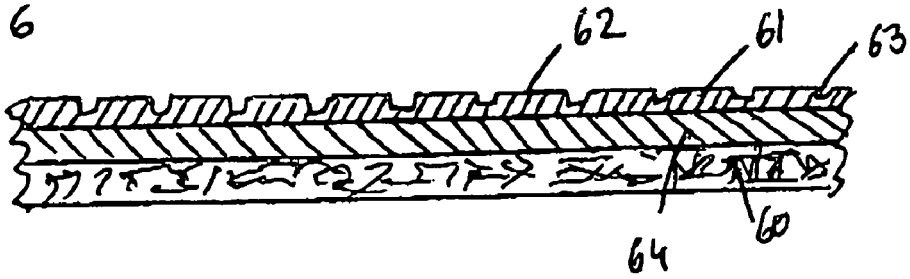
FIG. 6 is a similar view of a fifth embodiment of belt according to the invention.

FIG. 6 illustrates another embodiment of belt which comprises a supporting substrate 60, and two layers of different hardness materials. These comprise an upper layer 61 of a relatively hard material, such as polyurethane with 60–70 Shore-D hardness. Layer 61 provides an upper surface 62 which is formed with parallel machine direction grooves 63 for drainage of used slurry from the polishing site. A second, intermediate layer 64 is sandwiched between the relatively hard upper layer 61, and the substrate 60 and comprises a relatively soft material such as 60–70 Shore-A hardness polyurethane. The substrate 60 comprises, as in FIG. 2 a non-woven fibrous batt which is impregnated and reinforced with a suitable resin.

The structure superposing a relatively hard top surface material over a relatively soft layer provides the benefits of a hard outer surface 62, with the resilience of the softer layer 64, reduces pressure on the wafer and thereby minimises the risk of wafer breakage.

Figure 7:
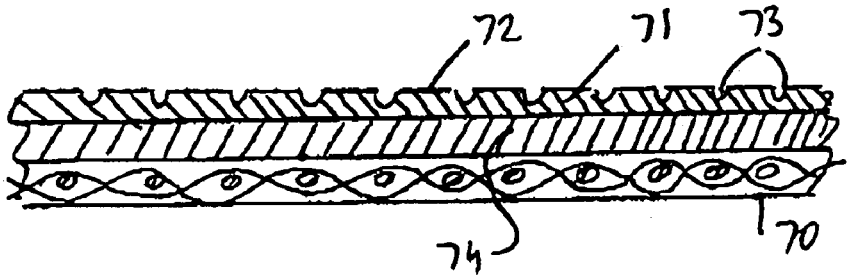
FIG. 7 is a similar view of a sixth embodiment of belt according to the invention.

FIG. 7 illustrates a further embodiment of belt which comprises a woven supporting substrate 70, carrying an upper layer 71 of a relatively soft material, such as 60–70 Shore-A hardness polyurethane, providing an upper surface 72 with drainage grooves 73, and an intermediate sandwiched layer 74 of a relatively hard material, such as 60–70 Shore-D hardness polyurethane. This arrangement is essentially the reverse of that of FIG. 6, but gives a compliant top surface and hard middle layer which provides the stiffness necessary to hold the wafer in place during planarisation.

Figure 8:
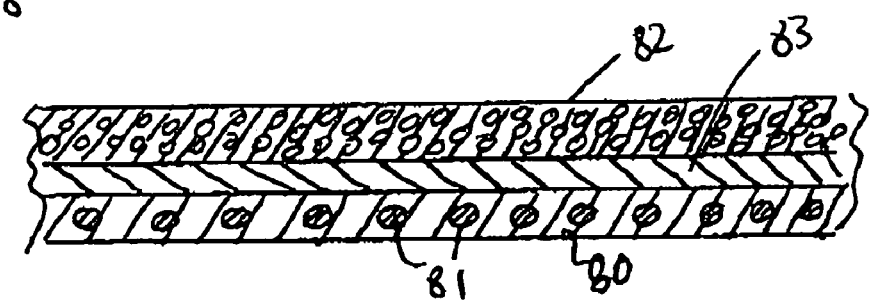
FIG. 8 is a similar view of a seventh embodiment of belt according to the invention.

FIG. 8 shows another embodiment of belt according to the invention, comprising a supporting substrate 80 in the form of a membrane having machine direction reinforcing yarns 81 embedded therein. The membrane 80 may be perforated, although this is not shown. Membrane substrate 80 carries an upper layer 82 of foamed plastics material, eg polyurethane. This foam may be rigid or preferably flexible, and provides surface porosity to retain slurry material generated during planarisation. The necessary stiffness to hold the wafer in place is provided by an intermediate layer of harder, eg 60–70 Shore-D hardness polyurethane 83.

Figure 9:
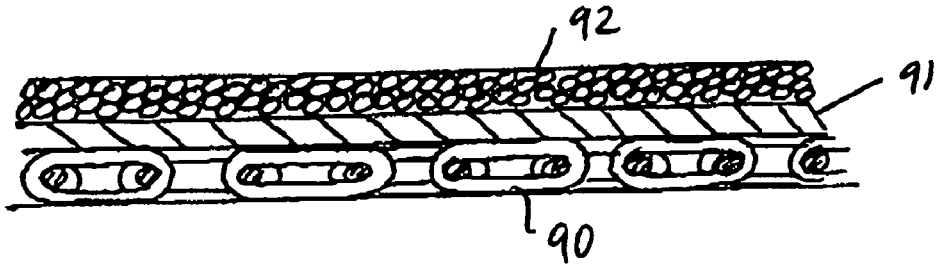
FIG. 9 is a similar view of an eighth embodiment of belt according to the invention.

FIG. 9 shows a yet further embodiment of belt comprising a spiral link fabric substrate 90, carrying an intermediate relatively hard layer 91, of eg 60–70 Shore-D hardness polyurethane, carrying an upper layer 92 of solid polyurethane containing beads which are heat activated during polyurethane curing to form pores in the surface, similar to a foam coating. The beads comprise expanded polystyrene pellets which are dispersed into the polyurethane.

The upper layer in any of the described embodiments may comprise at least one layer of partially fused polymeric particles, and/or comprise two or more thermoplastic polymers having different melting points. The sintered layer may optionally be reinforced by a textile material, e.g. a membrane, woven or nonwoven fabric, or chopped fibres. The layer may incorporate hollow microbeads of plastics, glass or soluble material (such as CMC) which latter break down to provide a porous surface. Glass beads are used for their abrasive properties.

Abrasive particles or fibres, such as $TiO_2$; $CeO_2$; SiC; $Si_3N_4$; $Al_2O_3$; glass; silicates; $BaCO_3$; $CaCO_3$; diamond or carbon may be added to the upper layer, which may also or instead consist of a transparent coating.

The surface of the upper layer may be provided with a micro textured coating, that is with micro-scale grooves or roughness, formed for example by machining, laser cutting (preferably with an ablation or excimer laser), or chemical means (e.g. by dissolving soluble particles such as sugar or cooking salt present in the upper layer.

Upon curing of the polyurethane these pellets expand to form hollow beads which are cut open when the cured belt is conditioned eg by grinding, providing location on the belt surface which can retain slurry.

Any of the various substrates illustrated may be used in combination with any of the single layer (FIGS. 2 to 4) or double layer (FIGS. 5 to 9) structures described.

In the above embodiments the substrate fabric 20, 30 or cover layer 53 may be an endless woven material to avoid the weakness imported by a splice or seam. The fabric may be woven from yarns of a high tensile strength and relatively low elongation, such as meta- or para-aramids eg KEVLAR, NOMEX or TWARON; as well as PBO or its derivatives; polyetherimide, polyetherketone, PEEK, gel-spun UHMW polyethylene (eg DYNEEMA or SPECTRA); or polybenzimidazole. Yarns of these compositions may be mixed or blended and mineral fibres such as glass, carbon or ceramic yarns including rock fibres (eg basalt) on there own or mixed or blended with polymer yarns may be used. The aramids are most preferred however on account of their low weight and high strength.

The coating may also be any high abrasion resistance thermoset or thermoplastic polymer such as aliphatic polyamides, aliphatic aromatic copolyamides, silicones or epoxy resins.

Woven metal mesh and perforate metal sheet belt substrate may be used with the belt interstices being occupied by rivets or filers of polymeric material, improving bond strength between the polymer and the metal.

The main advantage of a chemical-mechanical polishing belt according to the invention is that improved bond strength is obtained between the preferably synthetic polymer substrate and the polymer coating. As a result, not only does the coating tend not to flake off so readily, but thicker coatings can be applied, possibly impregnating a substantial proportion of the substrate or even fully encapsulating it, meaning that belts last a lot longer on the machines before needing to be removed.

The belt is typically 1.5–3 metres in length, measured as the inner circumference of the endless belt, 0.2–0.6 metres in width, and 0.1–0.6 cm thick. The coating typically comprises 40–70% of the thickness.

The belt according to the invention may be applicable in other industries, for example for polishing and planarising optical flats and mirrors prior to coating of the latter with a reflective metallic layer.

What is claimed is:

1. A polishing tool for polishing silicon wafers, said tool comprising an endless belt which includes a continuous unseamed textile fabric supporting a polishing layer, said polishing layer comprising a microcellular or microporous urethane, wherein said fabric is woven and comprises aramid yarns oriented in the lengthwise direction and said polishing layer includes two layers which are of different hardness.

2. A polishing tool according to claim 1 wherein an exposed surface of said polishing layer is formed with grooves.

3. A polishing tool according to claim 1 wherein an upper of said two layers includes beads of plastic, glass or a soluble material.

4. A polishing tool according to claim 1 wherein said polishing layers comprises hollow beads of plastic, glass or other soluble material.

5. An endless belt for polishing semiconductor wafers comprises a continuous unseamed textile fabric supporting a polishing layer, said polishing layer comprising a microcellular or microporous urethane, wherein said fabric is woven and includes aramid yarns oriented in the lengthwise direction, and said polishing layer comprises two layer which are of different hardness.

6. An endless belt according to claim 5 wherein an exposed surface of said polishing layer is formed with grooves.

7. An endless belt according to claim 5 wherein an upper of said two layers includes beads of plastic, glass or a soluble material.

8. An endless belt according to claim 5 wherein said polishing layers comprises hollow beads of plastic, glass or other soluble material.

9. An endless belt for polishing optical flats comprising a continuous unseamed textile fabric supporting a polishing layer, said polishing layer comprising a microcellular or micorporous urethane, wherein said fabric is woven and comprises aramid yarns oriented in the lengthwise direction and said polishing layer includes two layers which are of different harness.

10. An endless belt according to claim 9 wherein an exposed surface of said polishing layer is formed with grooves.

11. An endless belt according to claim 9 wherein an upper of said two layers includes beads of plastic, glass or soluble material.

12. An endless belt according to claim 9 wherein said polishing layers comprises hollow beads of plastic, glass or other soluble material.

13. An endless belt for polishing mirrors comprising a continuous unseamed textile fabric supporting a polishing layer, said polishing layer comprising a microcellular or microporous urethane, said polishing layer including two layers which are of different hardness.

14. An endless belt according to claim 13 wherein said fabric is woven and comprises aramid yarns oriented in the lengthwise direction.

15. An endless belt according to claim 13 wherein an exposed surface of said polishing layer is formed with grooves.

16. An endless belt according to claim 13 wherein an upper of said two layers includes beads of plastic, glass or soluble material.

17. An endless belt according to claim 13 wherein said polishing layers comprises hollow beads of plastic, glass or other soluble material.

* * * * *